US008438788B2

(12) United States Patent
Bell et al.

(10) Patent No.: US 8,438,788 B2
(45) Date of Patent: May 14, 2013

(54) APPARATUS FOR HARVESTING RAINWATER

(75) Inventors: Robert B. Bell, Douglasville, GA (US); John J. McNichol, Holland, PA (US); Joseph K. Wolf, Lancaster, PA (US); J. Michael Connelly, Manheim, PA (US)

(73) Assignee: Euramax International, Inc., Norcross, GA (US)

( * ) Notice: Subject to any disclaimer, the term of this patent is extended or adjusted under 35 U.S.C. 154(b) by 615 days.

(21) Appl. No.: 12/731,873

(22) Filed: Mar. 25, 2010

(65) Prior Publication Data

US 2011/0232766 A1 Sep. 29, 2011

(51) Int. Cl.

| | |
|---|---|
| ***E04D 13/00*** | (2006.01) |
| ***B01D 35/00*** | (2006.01) |
| ***B01D 29/88*** | (2006.01) |
| ***B01D 35/28*** | (2006.01) |
| ***B01D 35/02*** | (2006.01) |

(52) U.S. Cl.

USPC ..... 52/16; 52/12; 210/154; 210/162; 210/433.1; 210/434; 210/435; 210/446; 210/451; 210/452; 210/455; 210/467

(58) Field of Classification Search ..... 210/433.1, 210/434, 452, 455, 467, 435, 446, 451

See application file for complete search history.

(56) References Cited

U.S. PATENT DOCUMENTS

| | | | | | |
|---|---|---|---|---|---|
| 1,283,278 | A | * | 10/1918 | Ott | 210/340 |
| 3,896,005 | A | * | 7/1975 | Zuccolotto | 202/185.1 |
| 3,992,886 | A | * | 11/1976 | Scott | 405/36 |
| 4,051,042 | A | * | 9/1977 | Tullier et al. | 210/409 |
| 4,182,376 | A | | 1/1980 | Nilsson | 137/874 |
| 4,386,484 | A | | 6/1983 | van Berne | 52/16 |
| 4,428,394 | A | | 1/1984 | Wright | 137/122 |
| 4,473,470 | A | * | 9/1984 | Loutit | 210/409 |
| 4,726,151 | A | | 2/1988 | Vitale | 52/16 |
| 5,114,594 | A | * | 5/1992 | Rosebrock et al. | 210/767 |
| 5,681,455 | A | * | 10/1997 | Takai et al. | 210/154 |
| 5,863,151 | A | | 1/1999 | Chapotelle | 405/52 |
| 2011/0041416 | A1 | * | 2/2011 | Schmidt et al. | 52/16 |

FOREIGN PATENT DOCUMENTS

DE 3518302 * 11/1986

* cited by examiner

*Primary Examiner* — Benjamin Kurtz
(74) *Attorney, Agent, or Firm* — Miller Law Group, PLLC

(57) ABSTRACT

A rainwater collection apparatus is formed with an outer sleeve member that is adapted to connect with upper and lower downspout portions, and with an internal colander that is operable to collect and filter the rainwater flowing through the upper downspout portion. The colander has an upper flanged edge that removes water flowing along the inside surface of the downspout, a filter area including a plurality of apertures for the passage of rainwater into a catch basin, and a support flange that rests on a base ledge formed on the outer sleeve to define the catch basin. A discharge spout drains the collected rainwater from the catch basin to a remote storage container. An internal opening in the colander allows the passage of debris and the overflow of rainwater from the catch basin through apertures in the colander for discharge through the lower downspout portion.

14 Claims, 7 Drawing Sheets

Fig. 4
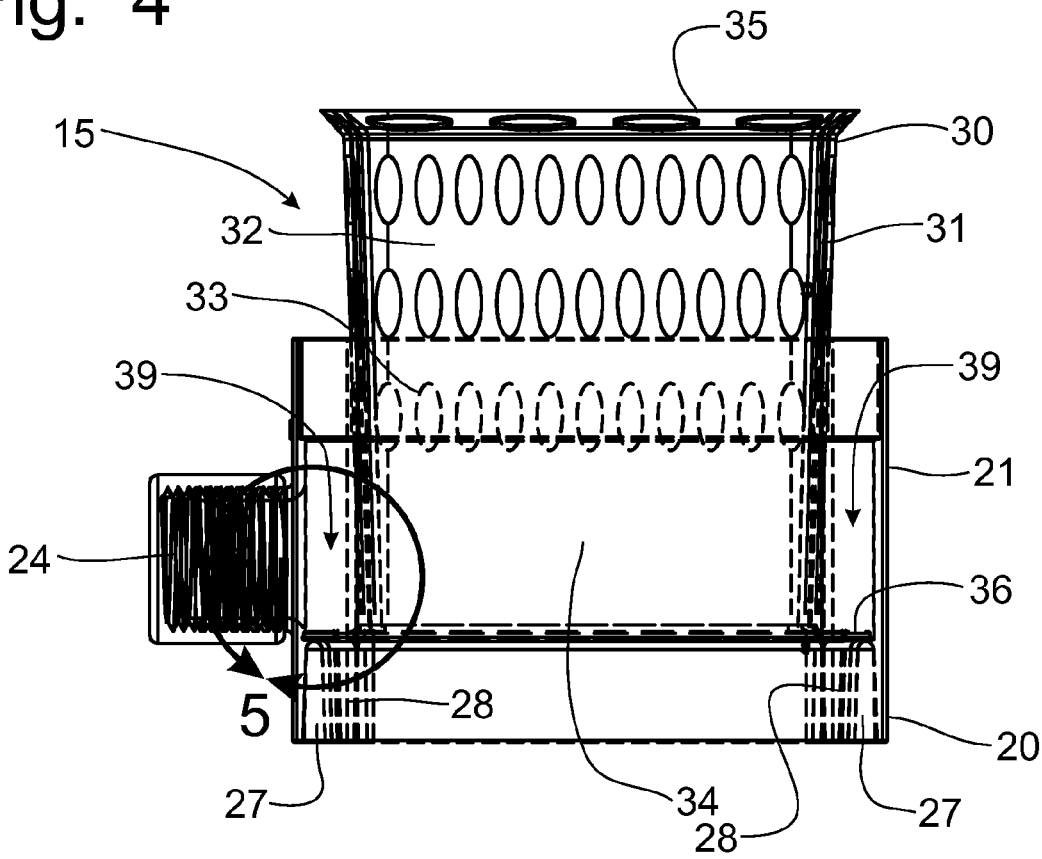
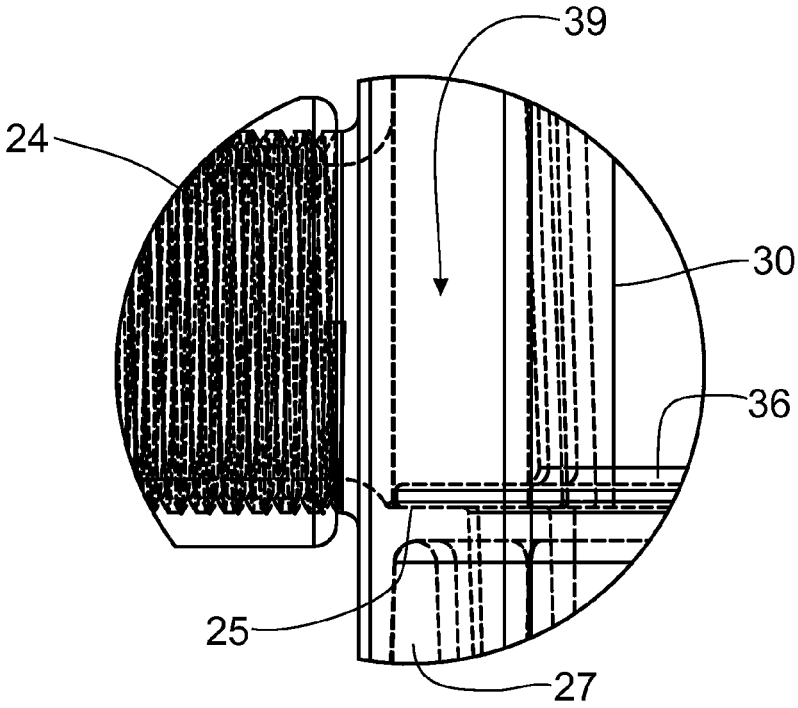
Fig. 5

Fig. 6
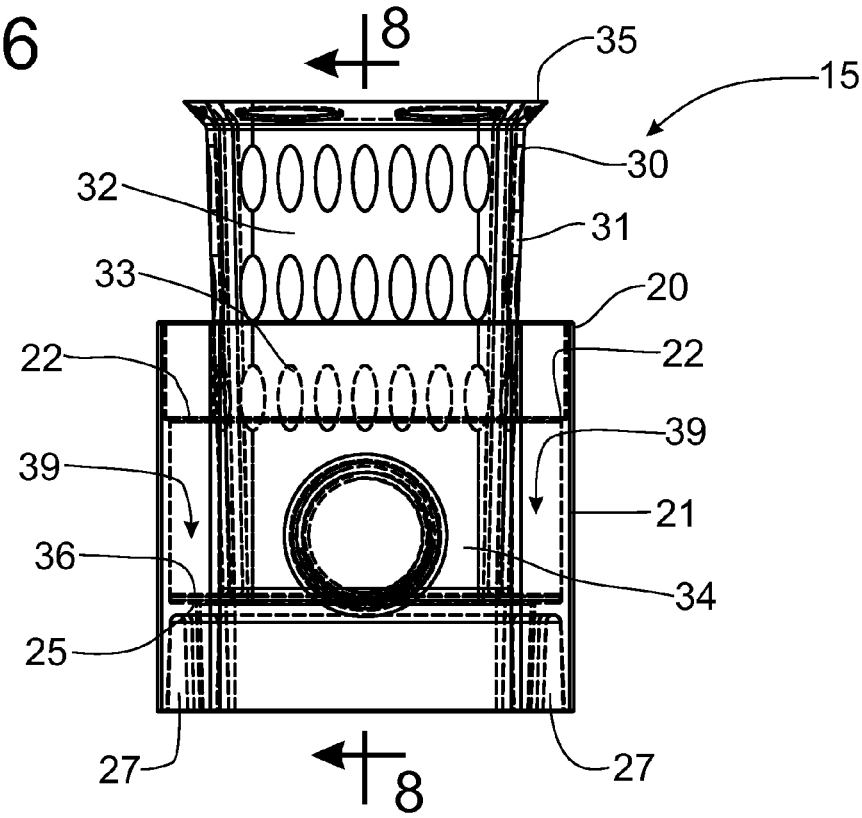
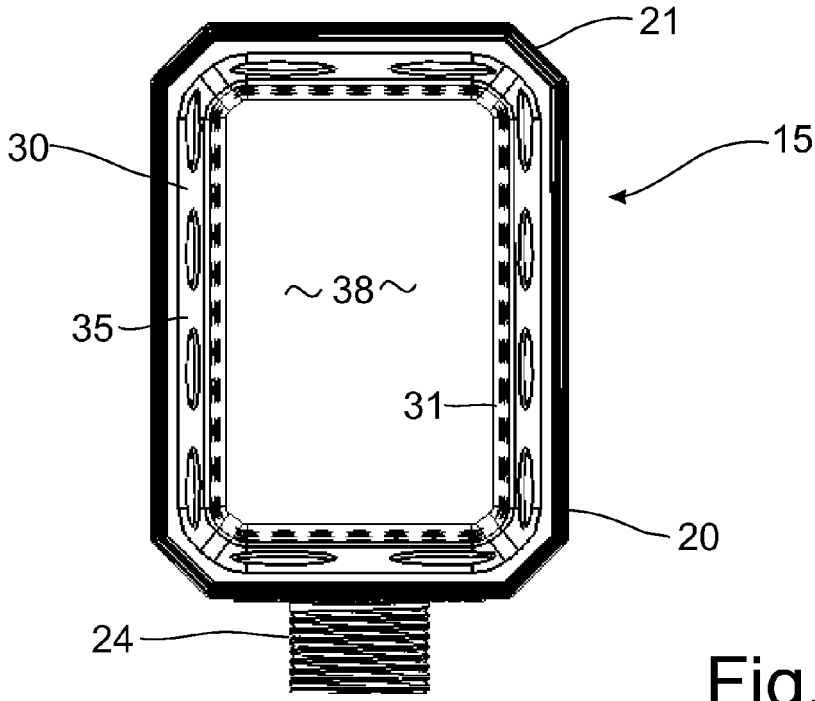
Fig. 7

Fig. 8
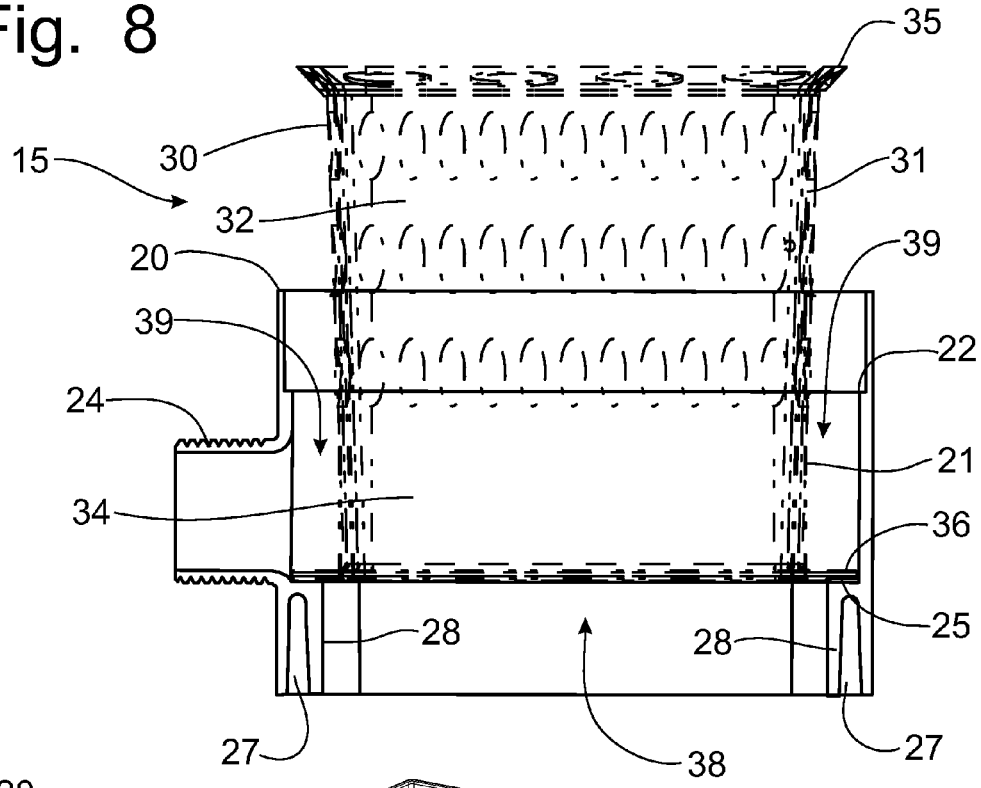
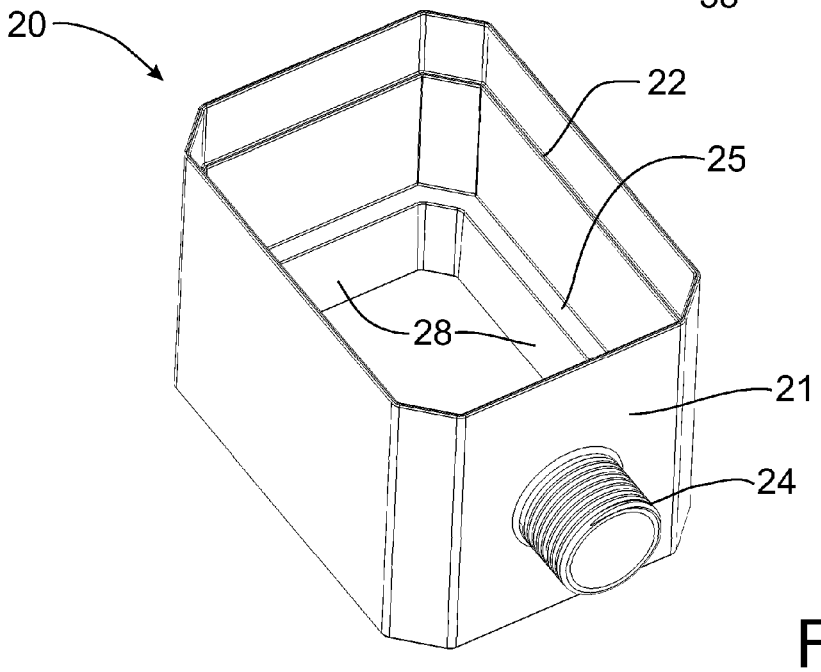
Fig. 9

Fig. 10
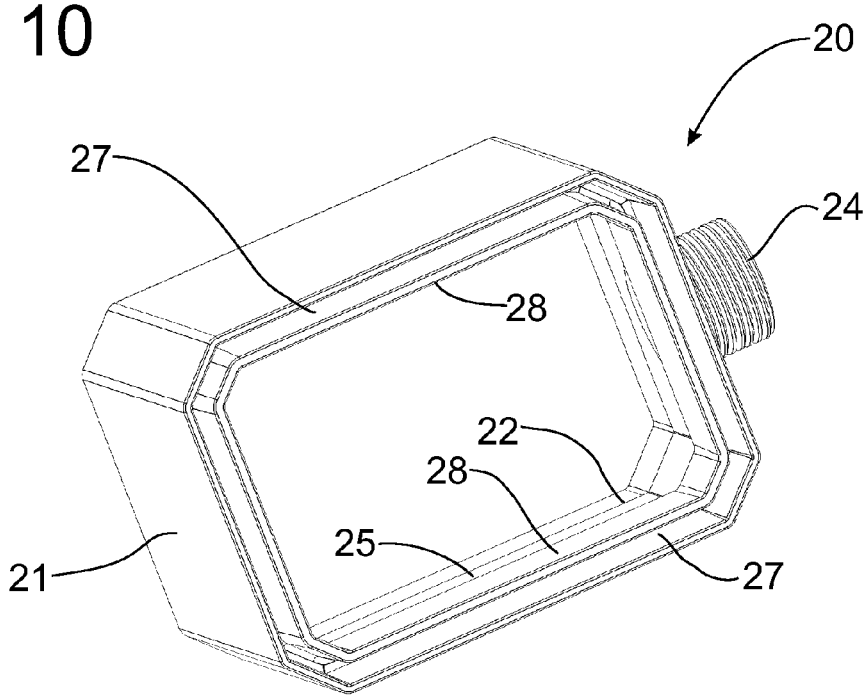
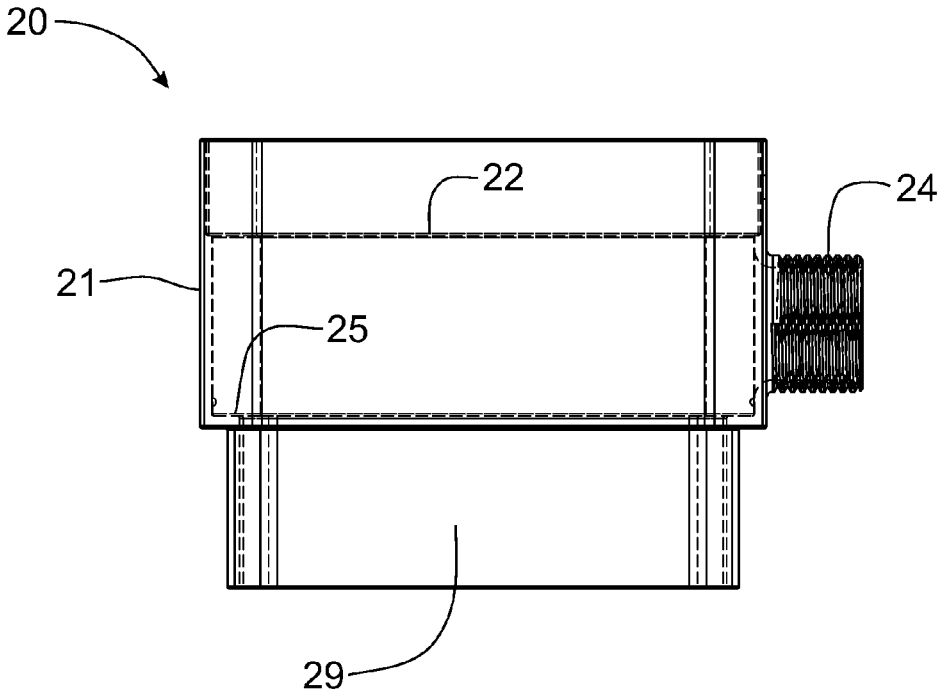
Fig. 11

APPARATUS FOR HARVESTING RAINWATER

FIELD OF THE INVENTION

This invention relates generally to an apparatus cooperable with a downspout to collect rainwater for subsequent use thereof and, more particularly, to a device positioned at an intermediate location on the downspout to extract rainwater therefrom for diversion to a location remote from the downspout.

BACKGROUND OF THE INVENTION

Gutters and downspouts are mounted on most residential and commercial structures along the lower edge of the roof of the structure to receive water draining off of the roof, such as during a rainstorm. Gutters come in many different styles, including K gutter, half round gutter, or commercial box gutter, but all are generally formed with an open top through which water is received into a trough or channel that delivers the water by gravity to a downspout for discharge away from the building structure. Gutters are often mounted on a plurality of hangers that are spaced along the length of the gutter and fastened to fascia boards by nails or screws such that the gutter is suspended from the hangers. The downspout is connected to an outlet of the gutter to provide a conduit to drain the collected rainwater from the gutter for discharge along the surface of the ground and direct the rainwater away from the building structure.

The collection of rainwater has been a practice in use for many years. Most often, the collected rainwater is used for non-potable activities, such as irrigation, washing clothes, washing hair, etc. Typically, the rainwater is collected from the downspout and stored in a collection container, such as a barrel, and utilized at a subsequent date as desired. The use of collected rainwater has an inherent cost advantage over the use of public water as the rainwater is collected without any significant expense. Also, the utilization of collected rainwater provides a conservation function and allows for a better management of the less cost-effective water supplies. The harvesting of rainwater is an international practice and is a primary lifeline in many third world countries. The scarcity of water and rain in many regions of the world is a worldwide problem and the ability to capture water being discarded from the rooftops is becoming popular.

Collection systems for harvesting rainwater have been developed for many years and are generally defined as a device for intercepting the downward flow of rainwater within a downspout and diverting the rainwater to a location remote from the downspout. One such rainwater collector can be found in U.S. Pat. No. 4,182,376, granted to Bernt Nilsson on Jan. 8, 1980, wherein a dispensing device is formed to be inserted into an intermediate portion of a downspout and defines a collection pocket by a circumferential wall portion that drains into a discharge spout. The Nilsson device does not include any filtration of the descending rainwater, but does provide an overflow from the collection pocket over the edge thereof into the lower downspout portion. In U.S. Pat. No. 4,386,484, granted on Jun. 7, 1983, to Joost van Berne, et al, the collection device incorporates a reception cavity into which rainwater is deflected until the cavity is filled, whereupon an opening at the upper part of the cavity allows overflow back into the lower downspout portion. The reception cavity is formed with a discharge spout to drain rainwater from the cavity to a location remote from the device.

Another deflector apparatus is found in the collection device disclosed in U.S. Pat. No. 4,428,394, issued on Jan. 31, 1984, to Jack Wright, et al, in which rainwater is deflected from the downspout into a discharge spout for diversion of the rainwater into a remote collection vessel. The Wright deflection apparatus is operably connected to a float associated with the collection vessel so that when the collection vessel is filled with diverted rainwater, the deflector apparatus is shifted to allow the rainwater to continue uninterrupted down the downspout. The collection apparatus in U.S. Pat. No. 4,726,151, issued to Benedetto Vitale on Feb. 23, 1988, is connected directly to the gutter discharge and collects rainwater in a reservoir having an outlet projecting upwardly therein to define a weir over which the collected rainwater will flow into the attached downspout. The reservoir is formed with a discharge spout to allow the diversion of the collected rainwater to a remote location.

A similar collection apparatus is shown in U.S. Pat. No. 5,114,594, issued on May 19, 1992, to Linda Rosebrock, et al, in which the vertically oriented reservoir is positioned at an intermediate portion of the downspout and includes a bypass opening through which rainwater can overflow into the lower downspout portion and a discharge spout through which water can be diverted. The collection apparatus in U.S. Pat. No. 5,863,151, issued on Jan. 26, 1999, to Dan Chapotelle, is substantially identical to the apparatus disclosed in the Rosebrock patent, wherein a reservoir collects rainwater from an intermediate portion of a downspout with an overflow spout that allows excess water to transfer to the lower downspout portion and a discharge spout to divert collected rainwater to a remote location.

It would be desirable to provide a collection apparatus for harvesting rainwater from a downspout by intercepting the rainwater flowing along the sides of the downspout through surface adhesion so that the rainwater will pass through an internal filter that deflects debris carried by the rainwater into the lower downspout portion, while the collected rainwater is diverted to a remote location. It would also be desirable to provide a rainwater collection apparatus that is easily connectable to the downspout so as to be positionable at an intermediate portion thereof.

SUMMARY OF THE INVENTION

It is an object of this invention to overcome the disadvantages of the prior art by providing a rainwater collection apparatus that harvests rainwater through the principle of surface adhesion.

It is another object of this invention to provide a rainwater collection apparatus that filters debris carried by the rainwater moving downwardly through the downspout.

It is a feature of this invention that the rainwater collection apparatus is formed with an inner colander that deflects rainwater flowing along the insides of the upper portion of the downspout into the inner colander for movement through apertures in the colander into a catch basin between the colander and the outer sleeve.

It is another feature of this invention that the colander is formed with a belt area that is devoid of apertures and helps define the catch basin.

It is an advantage of this invention that the catch basin occupies a small cross-sectional area of the collection apparatus to allow for a maximum interior opening to allow the passage of debris from the colander into the lower downspout portion.

It is another advantage of this invention that the colander filters debris from the rainwater for passage through an interior opening into the lower downspout portion.

It is still another feature of this invention that the colander is flared at the upper portion thereof to deflect rainwater flowing along the inside walls of the upper downspout portion, and has a flange along the lower portion thereof to seat on a retainer ledge formed in the outer sleeve to define the catch basin.

It is still another feature of this invention that the outer sleeve is formed with a first horizontal ridge to stop the insertion of the upper downspout portion into the outer sleeve.

It is yet a further feature of this invention that the outer sleeve is also formed with a base ledge that seats the flange of the colander, the base ledge being located below the horizontal ridge.

It is still another advantage of this invention that the catch basin includes a discharge spout for diverting the collected rainwater from the catch basin to a remote location for storage thereof.

It is yet another feature of this invention that the colander incorporates an overflow protection at the lowest set of apertures such that the reception of an abundance of rainwater at a rate faster than can flow through the discharge spout will flow into the interior opening and be removed through the lower downspout portion.

It is yet another advantage of this invention that the outer sleeve incorporates a downwardly extending portion that fits internally of the lower downspout portion for connection thereto.

It is another advantage of this invention that the downwardly extending portion assures that rainwater will not leak past the collection apparatus and flow outside of the downspout.

It is still another object of this invention to provide a rainwater collection apparatus that is operable to harvest rainwater flowing downwardly through a downspout utilizing an outer sleeve that is substantially the same cross-sectional shape and size of the downspout.

It is yet another advantage of this invention that the collected rainwater will overflow back into the downspout through the apertures in the colander member if the storage tank for the collected rainwater is full, or if the cap has been placed on the discharge spout to prevent the passage of water from the catch basin.

It is still a further object of this invention to provide a rainwater collection apparatus that will collect and filter rainwater from a downspout, which is durable in construction, inexpensive of manufacture, carefree of maintenance, facile in assemblage, and simple and effective in use.

These and other objects, features and advantages are accomplished according to the instant invention by providing a rainwater collection apparatus including with an outer sleeve member that is adapted to connect with upper and lower downspout portions, and with an internal colander that is operable to collect and filter the rainwater flowing through the upper downspout portion. The colander has an upper flanged edge that removes water flowing along the inside surface of the downspout, a filter area including a plurality of apertures for the passage of rainwater into a catch basin, and a support flange that rests on a base ledge formed on the outer sleeve to define the catch basin. A discharge spout drains the collected rainwater from the catch basin to a remote storage container. An internal opening in the colander allows the passage of debris and the overflow of rainwater from the catch basin through apertures in the colander for discharge through the lower downspout portion.

BRIEF DESCRIPTION OF THE DRAWINGS

The advantages of this invention will become apparent upon consideration of the following detailed disclosure of the invention, especially when taken in conjunction with the accompanying drawings wherein:

FIG. 4 is an enlarged side elevational view of the rainwater collection apparatus shown in FIG. 2, the colander being supported in its operative position on the outer sleeve member;

FIG. 5 is an enlarged detail view showing a portion of the catch basin adjacent the discharge spout, corresponding to circle 5 in FIG. 4;

FIG. 6 is a front elevational view of the rainwater collection apparatus shown in FIG. 4;

FIG. 7 is a top plan view of the rainwater collection apparatus shown in FIG. 6;

FIG. 8 is a cross-sectional view of the outer sleeve member taken along lines 8-8 in FIG. 6, the colander being shown in phantom in an operative position;

FIG. 9 is a top perspective view of the outer sleeve member with the colander removed for purposes of clarity to view the horizontal ridge and base ledge internally thereof;

FIG. 10 is a bottom perspective view of the outer sleeve member to depict the channel formed therein for the reception of the lower downspout portion; and FIG. 11 is a side elevational view of an alternative configuration of the outer sleeve member formed with a larger downspout engagement member.

DETAILED DESCRIPTION OF THE PREFERRED EMBODIMENT

Figure 1:
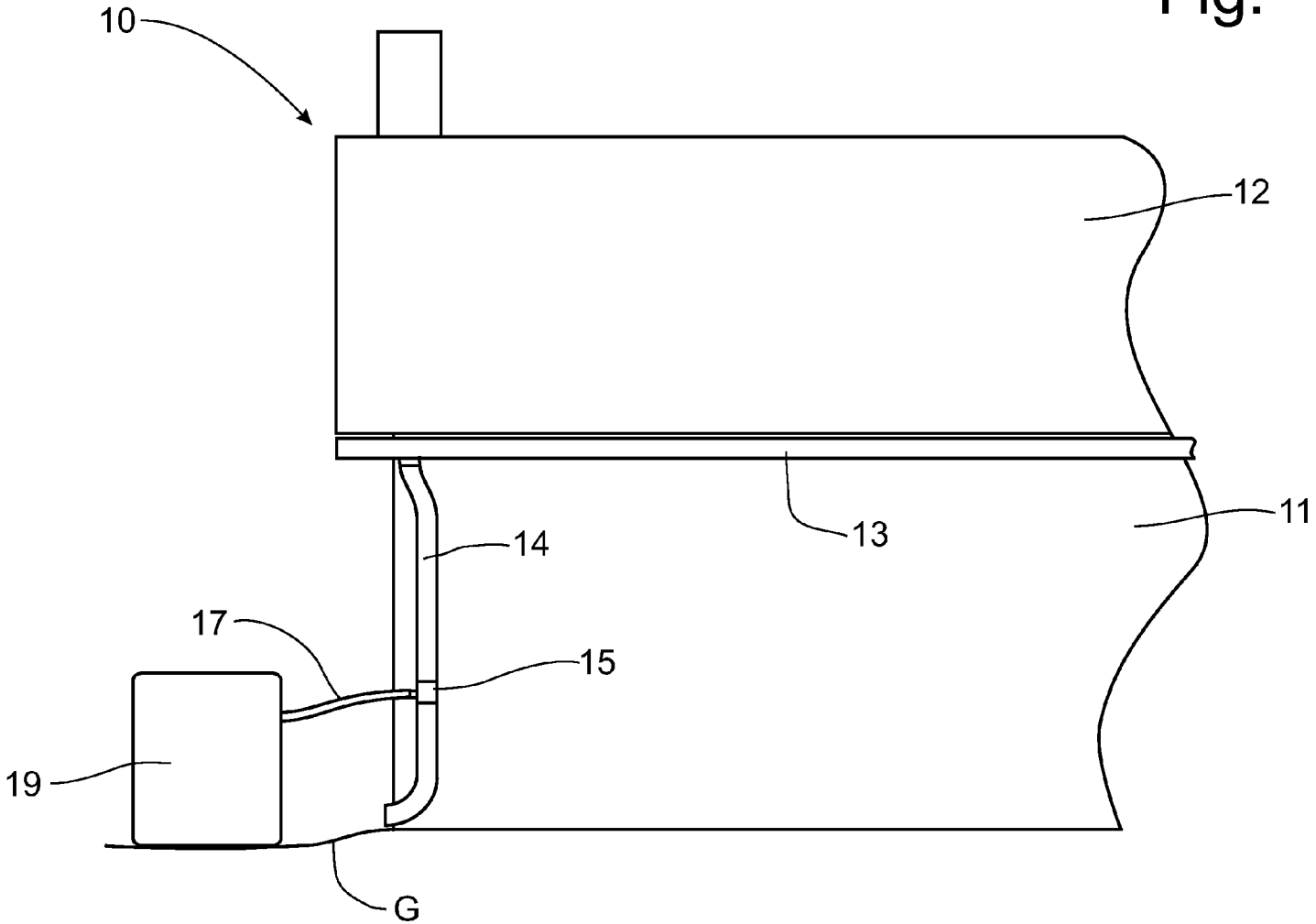
FIG. 1 is a schematic elevational view of a portion of a building structure having a gutter and downspout equipped with a rainwater collection apparatus incorporating the principals of the instant invention, the harvested rainwater being diverted to a representative remote storage container.

Referring now to FIG., 1, a representative building structure 10 is depicted in which an upright wall 11 supports a pitched roof 12 having mounted along the lower edge thereof a gutter 13 to collect rainwater flowing over the roof by gravity and heading toward the ground G. The gutter 13 is sloped slightly to induce a flow of the collected rainwater toward a discharge opening to which is attached a downspout 14. The rainwater flows downwardly through the downspout and is conventionally discharged to the ground G. According to the principles of the instant invention, however, a rainwater collection apparatus 15 that is mounted at an intermediate location on the downspout 14 between the upper and lower portions thereof to harvest the rainwater from the downspout 14. The harvested rainwater is then conveyed by a conduit 17, such as a water hose, to a remote storage container 19, such as a sealed barrel or plastic drum or the like. Preferably, the conduit 17 is connected to the storage container 19 at a location below the top of the container 19, preferably approximately eight inches below the top, so that the principle of water displacement will push the rainwater back through the conduit 17 and overflow into the downspout 14, as will be described in greater detail below.

The rainwater collection apparatus 15 incorporating the principles of the instant invention can best be seen in FIGS. 2-8. The rainwater collection apparatus 15 includes an outer sleeve member 20 in which is mounted a colander member 30. The downspout 14 is divided into an upper downspout portion 14*a* and a lower downspout portion 14*b* with the rainwater collection apparatus 15 being positioned at an intermediate position therebetween. The outer sleeve 20 is connected to, such as by fasteners (not shown) so as to be removable from, both the upper and lower downspout portions 14*a*, 14*b* to form an integral assembly. The colander 30 is seated within the outer sleeve member 20 as will be described in greater detail below. With respect to shape, gutters and downspouts can be formed in a variety of sizes and shapes, including rectangular in 2×3, 3×4 and 4×5 inch dimensions or round in 4, 5 and 6 inch dimensions. The rainwater collection apparatus 15 is formed in sizes and shapes to correspond to the specific configuration of the downspout 14.

As best seen in FIGS. 2, 3, 9 and 10, the outer sleeve member 20 is preferably formed of molded polyvinylchloride (PVC); however, other materials can be utilized to allow fabrication or molding into the configuration described in greater detail below. The outer sleeve member includes an outer shell 21 that is formed in a size and shape to mate with the downspout 14. Preferably, the outer shell 21 is formed with a horizontal, circumferentially extending ridge 22 that serves as a stop against which the upper downspout portion 14*a* is positioned to allow the outer shell 21 to be connected, such as by fasteners (not shown), to the upper downspout portion 14*a*. The lowermost rim of the outer shell 21 is preferably formed with a trough receptacle 27, best seen in FIG. 9, into which the rim of the lower downspout portion 14*b* can be inserted to be secured to the outer sleeve 20, such as by fasteners (not shown). The trough receptacle 27 includes an inner leg 28 that extends into the interior of the lower downspout portion 14*b* so that any leakage of rainwater between the outer sleeve 20 and the colander 30 will pass back into the downspout 14*b* for subsequent disposal. In the alternative, the lowermost rim of the outer shell 21 can be formed with a recessed inner leg 29 that extends down into the lower downspout portion 14*b*, as is depicted in FIG. 11

The outer sleeve 20 is also formed with a horizontal, circumferentially extending base ledge 25 located on top of the trough receptacle 27 and extending inwardly from the outer shell 21 further than the horizontal ridge 22. The base ledge 25 supports the colander member 30, as will be described in greater detail below, and helps define a circumferential catch basin 39 to receive the harvested rainwater. The outer shell 21 also includes a discharge spout 24 located on one side thereof immediately above the base ledge 25 so that the harvested rainwater collected in the catch basin 39 will drain out of the catch basin 39 and into the conduit 17 detachably connected to the threaded discharge spout 24. Preferably, the threads on the discharge spout 24 are formed to mate with the standard coupling on a garden hose. A detachable cap 40 can be mounted on the threaded discharge spout 24 to seal the discharge spout 24 from the passage of rainwater when mounted thereon.

Referring now to FIGS. 2-8, the details of the colander member 30 can best be seen. The colander member 30 has a similar shape to the outer sleeve member 20, but has a smaller size so as to be able to fit within the outer shell 21 and be supported on the base ledge 25. The colander member 30 has a main body portion 31 terminating at a flared upper edge 35 that projects upwardly and outwardly from the main body portion 31 and a lower generally horizontal flange 36 extending outwardly from the main body portion 31. The main body portion 31 includes an upper apertured filter area 32, including a lower row of apertures 33, and a lower solid belt area 34 extending upwardly from the flange 36. The main body portion 31 encircles an opening 38 that passes through the colander 30 and provides a passage to the lower downspout portion 14*b*. The main body portion 31 is flared outwardly from the bottom at the flange 36 to the top at the flared edge 35 so that the main body portion 31 is not quite vertically oriented. When seated within the outer sleeve member 20, the flange 36 rests on the base ledge 25 and the filter area 32 projects upwardly above the outer shell 21 such that the flared upper edge 35 terminates proximate to, or in engagement with, the inside wall surface of the upper downspout portion 14*a*.

When placed into the operative position within the outer sleeve member 20, the colander 30 is spaced inwardly from the outer shell 21 to define a circumferential gap between the main body portion 31 of the colander 30 and the outer shell 21. This circumferential gap creates a catch basin 39 defined by the inside wall of the outer shell 21, the belt area 34 of the main body portion 31 and the flange 36 resting on the base ledge 25. The height of the belt area 34, and thus the height of the catch basin 39, is preferably greater than the diameter of the discharge spout 24. In the event excess rainwater is collected in the catch basin 39 and cannot be discharged through the discharge spout 24, the collected rainwater will overflow through the lowermost row of apertures 33 and pass through the opening 38 into the lower downspout portion 14*b*.

For a three inch by four inch rectangular downspout, the catch basin 39 would preferably have a horizontal dimension measured at the flange 36 of approximately ⅜ extending around the perimeter of the colander 30 and a height measured from the flange 36 to the lowermost row of apertures 33 of approximately 1 and ¼ inches. Accordingly, the catch basis occupies approximately 10-20% of the overall cross-sectional area of the downspout 14, allowing a large opening 38 through the center of the colander 30 for the passage of debris shed off of the filter area, as will be described in greater detail below. The overall height of the outer sleeve member 20 extends for approximately two and one-quarter inches above the base ledge 25, while the colander has a height greater than that of the outer sleeve member 31. The filter area 32 may be manufactured from synthetic or natural materials that have properties to prevent bacterial contamination of the harvested rainwater and/or contamination or breeding of insects and pests. A secondary filter (not shown) can be inserted to exclude finer particulates from passing through the filter area 33.

The general purpose of the rainwater collection apparatus 15 is to harvest filtered rainwater from the downspout 14 by capturing the rainwater in the catch basin 39 when the collected rainwater can be diverted to a remote storage container 19. The colander member 30 will capture a portion of the rainwater flowing along the interior walls of the downspout 14 through the process of surface adhesion. As the rainwater travels inside the downspout, a great proportion of this rainwater will be flowing along the interior walls, as opposed to being in a "free fall" within the central portion of the downspout 14. Debris can be carried with the rainwater and can be flowing with the rainwater along the interior walls of the downspout or, depending on the size of the debris and the manner of entry into the downspout 14, may be in a "free fall" state within the central portion of the downspout 14.

Figure 2:
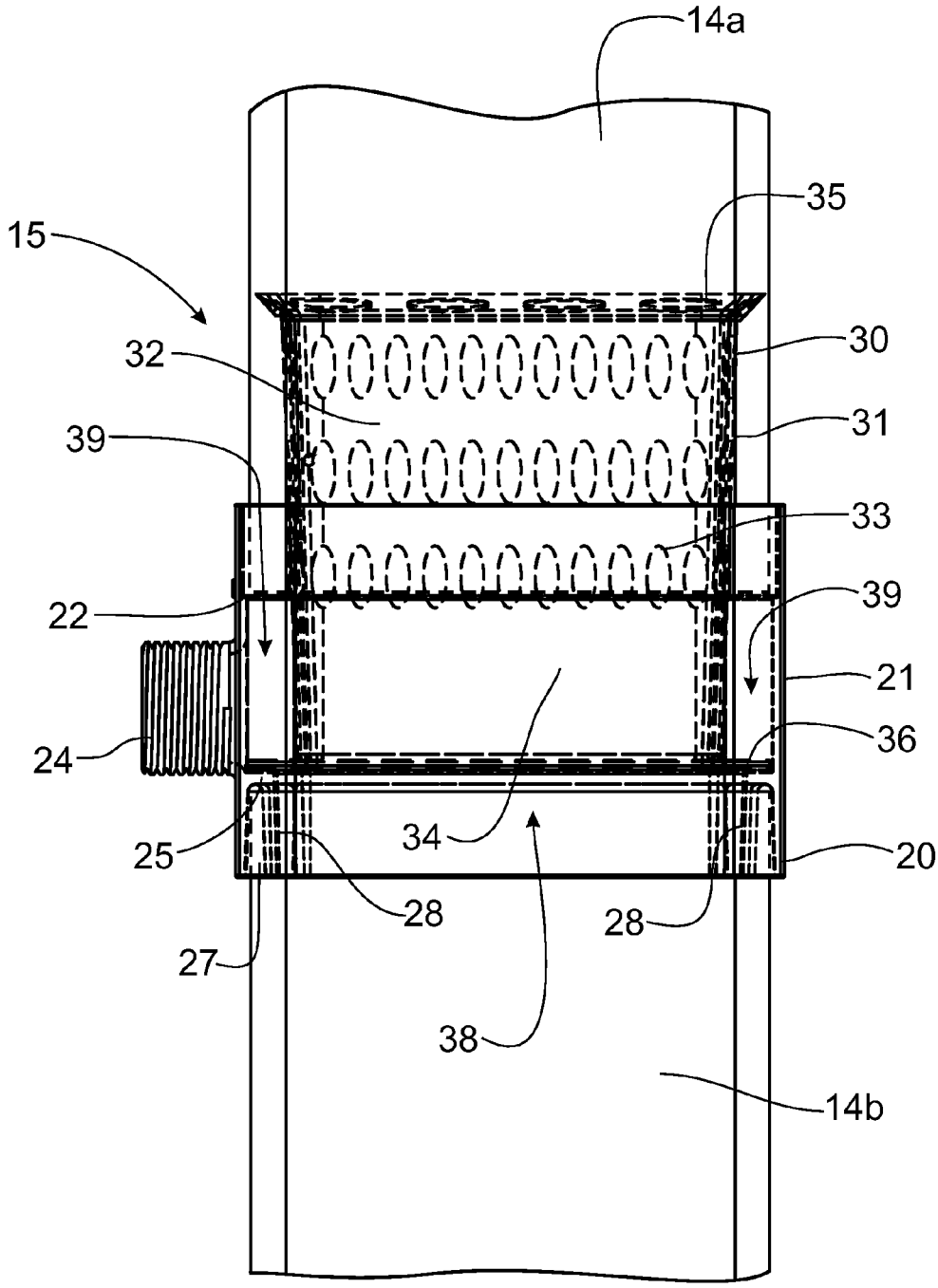
FIG. 2 is an enlarged elevational view of the rainwater collection apparatus incorporating the principals of the instant invention and being connected to upper and lower downspout portions as represented in FIG. 1, the colander member and the internal features of the outer sleeve member being shown in phantom.
Figure 3:
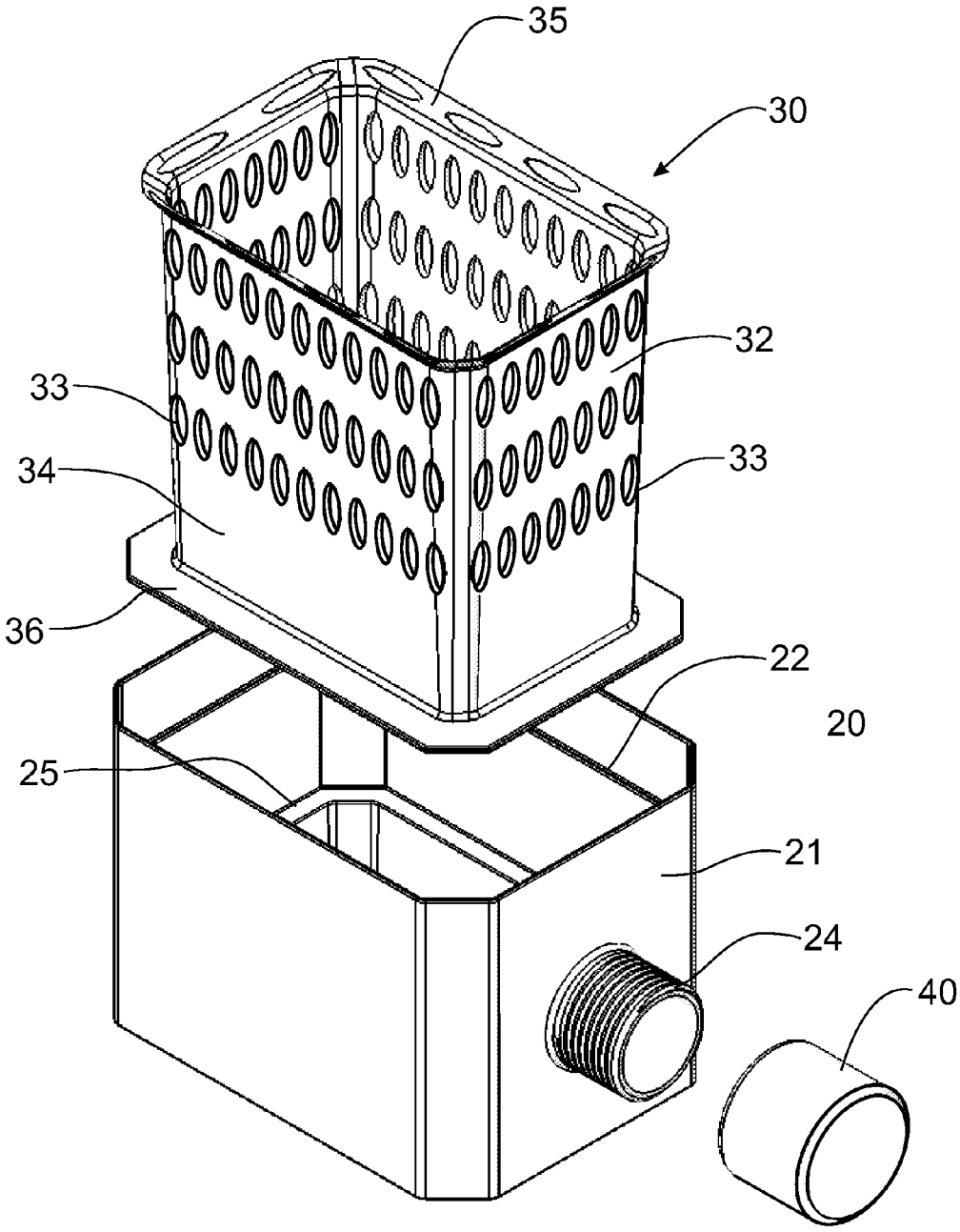
FIG. 3 is a perspective exploded view of the rainwater collection apparatus shown in FIG. 2.

The colander 30 maximizes water-capturing ability while also filtering debris from the captured rainwater. The upper-most flared edge 35 of the colander 30 is designed to touch or lie immediately adjacent to the interior wall of the upper downspout portion 14*a* above the outer sleeve member 20. The flared shaped of the upper edge portion 35 presents an angled surface extending downwardly and inwardly from the interior wall of the upper downspout portion 14*a*, as can be seen in FIG. 2. Accordingly, the flared upper edge 35 strips the rainwater from the interior wall of the upper downspout 14*a* and induces the flow thereof over the sloped surface of the flared upper edge portion 35 to the more vertical filter area 32 of the main body portion 31. The rainwater will still adhere to the filter area 32 through surface adhesion, but the bend between the flared upper edge 35 and the main body portion 31 urges any debris carried by the rainwater to project inwardly and pass through the opening 38. Meanwhile, the rainwater will pass through one of the apertures and drop into the catch basin 39. Large debris and any rainwater falling within the central portion of the upper downspout portion 14*a* will fall uninterrupted through the opening 38 and be carried through the lower downspout portion 14*b*.

The rainwater accumulating within the catch basin 39 will then flow through the discharge spout 24 and move through the conduit 17 to the remote storage container 19. If a large quantity of rainwater is collected through the filter area 32 into the catch basin 39, if the remote storage container is filled and rainwater backs up through the conduit 17, or if the cap 40 is applied to the discharge spout 24, the collected rainwater within the catch basin 39 will fill the catch basin 39 and overflow through the lowermost row of apertures 33 and fall through the opening 38 into the lower downspout portion 14*b*. Since the lowermost row of apertures 33 is located lower than the top of the outer sleeve member 20, the back-up of rainwater will not result in a leak in the rainwater collection apparatus 15, but simply pass through into the lower downspout portion 14*b*.

To install into an existing downspout 14, the downspout 14 would have to be cut at the appropriate height to create the upper and lower downspout portions 14*a*, 14*b*. The lower downspout portion 14*b* can then be inserted into the trough receptacle 27 and secured to the outer sleeve member 20 by fasteners or other means. With the alternative embodiment shown in FIG. 11, the extended inner leg 29 is inserted into the lower downspout portion 14*b* until the upper edge of the lower downspout portion 14*b* is flush against the outer shell 21 and then secured by fasteners or the like. The colander member 30 is then seated onto the base ledge 25 of the outer sleeve member 20 and the outer sleeve member 20 is slid over the upper downspout portion 14*a* until the bottom edge of the upper downspout portion 14*a* is stopped against the horizontal ridge 22, whereupon the upper downspout portion 14*a* is secured to the outer sleeve member 20 by fasteners or the like. A garden hose 17, or the cap 40, is applied to the outer threads of the discharge spout 24 to direct any collected rainwater to the remote storage container 19 or to render the rainwater collection apparatus 15 inoperative, respectively.

Once installed, operation of the rainwater collection apparatus 15 is dependent on the application of the cap 40 on the discharge spout 24. So long as a conduit 17 is connected to the discharge spout 24 and so long as the remote storage container 19 is not filled, the colander 30 will harvest filtered rainwater from the upper downspout portion 14*a* for receipt within the catch basin 39 and flow to the remote storage container 19. If the cap 40 is screwed onto the discharge spout 24, harvested rainwater will collect into the catch basin 39 until the catch basin 39 is filled, whereupon the overflow will pass inwardly through the lowermost row of apertures 33 and be discharged through the lower downspout portion 14*b*. The support of the flange 36 on the base ledge 25 is not sealed. Therefore, the collected rainwater within the catch basin 39 when the cap 40 is placed on the discharge spout 24 will ultimately leak between the flange 36 and the base ledge 25 and flow along the inside wall of the inner leg 28 and be discharged into the lower downspout portion 14*b* without leaking from the assembled rainwater collection apparatus 15.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A rainwater collection apparatus for mounting to a downspout on a building structure, comprising:

an outer sleeve member attachable to an upper downspout portion and a lower downspout portion, said outer sleeve member including a discharge spout;

a colander member mounted within said outer sleeve member and including a flared upper edge portion, a main body portion and a generally horizontal flange projecting outwardly from said main body portion, said main body portion including an upper filter area and a lower belt area, said colander being smaller in size than said outer sleeve member to define a catch basin therebetween in flow communication with said discharge spout.

2. The rainwater collection apparatus of claim 1 wherein said outer sleeve member is formed with a generally horizontal base ledge on which said flange is supported, said catch basin being defined in width by said flange mounted on said base ledge and in height by said belt area.

3. The rainwater collection apparatus of claim 1 wherein said colander projects vertically above said outer sleeve member such that said flared upper edge portion projects upwardly and outwardly from said main body portion to be positioned proximate to an interior wall surface of said upper downspout portion.

4. The rainwater collection apparatus of claim 3 wherein said filter area includes a plurality of apertures through which rainwater can pass into said catch basin.

5. The rainwater collection apparatus of claim 4 wherein said flared upper edge makes an angular bend from said filter area, said main body portion projecting upwardly and outwardly from said flange to said flared upper edge portion.

6. The rainwater collection apparatus of claim 5 wherein said discharge spout is selectively connectable to a conduit to diverted collected rainwater to a remote storage container or to a cap to force collected rainwater within said catch basin to overflow through said filter area into said lower downspout portion.

7. The rainwater collection apparatus of claim 5 wherein said outer sleeve member is formed with a generally horizontal ridge positioned above said base ledge to provide a stop for the insertion of said upper downspout portion into said outer sleeve member for connection therebetween, said outer sleeve member further having an inner leg projecting downwardly from said base ledge for insertion into said lower downspout portion and connection thereto.

8. The rainwater collection apparatus of claim 5 wherein said catch basin extends circumferentially around said colander member, said base ledge and said ridge extending circumferentially around an interior surface of said outer sleeve member.

9. In a rainwater collection apparatus having an outer sleeve member mountable to upper and lower downspout portions for the collection or rainwater from said upper downspout portion, the improvement comprising:

a colander member supported in said outer sleeve member and including a flared upper edge portion, a main body portion and a lower mounting flange projecting outwardly from said main body portion, said flared upper edge portion being positioned proximate to an interior wall surface of said upper downspout portion to collect rainwater moving along said interior wall surface, said main body portion including an apertured upper filter area and a solid lower belt area between said apertured upper filter area and said lower mounting flange.

10. The rainwater collection apparatus of claim 9 wherein said flared upper edge portion extends upwardly and outwardly from said main body portion and forming a bend therebetween to separate debris from rainwater collected by said flared upper edge portion.

11. The rainwater collection apparatus of claim 10 wherein said main body portion being angled outwardly from said mounting flange to said flared upper edge to provide a sloped filter area over which collected rainwater can flow from said flared upper edge portion.

12. The rainwater collection apparatus of claim 11 wherein said outer sleeve member is formed with a generally horizontal base ledge for the support of said mounting flange.

13. The rainwater collection apparatus of claim 12 wherein said main body portion is spaced inwardly from said outer sleeve member to define a gap therebetween creating a catch basin for receiving collected rainwater passing through said filter area, said catch area having a height corresponding to said belt area and being in flow communication with a discharge spout formed in said outer sleeve member for the diversion of the collected rainwater from said catch basin.

14. The rainwater collection apparatus of claim 13 wherein a lowermost set of apertures in said filter area serves as an overflow for said catch basin for the passage of overflowing rainwater into said lower downspout portion.

* * * * *